US010301707B2

(12) United States Patent
Lee et al.

(10) Patent No.: US 10,301,707 B2
(45) Date of Patent: May 28, 2019

(54) STEEL HAVING EXCELLENT WELDABILITY AND IMPACT TOUGHNESS OF WELDING ZONE

(71) Applicant: POSCO, Pohang-si (KR)

(72) Inventors: Hak-Cheol Lee, Pohang-si (KR); In-Shik Suh, Pohang-si (KR); Yong-Jin Kim, Pohang-si (KR); In-Gyu Park, Pohang-si (KR)

(73) Assignee: POSCO, Pohang-si (KR)

( * ) Notice: Subject to any disclaimer, the term of this patent is extended or adjusted under 35 U.S.C. 154(b) by 57 days.

(21) Appl. No.: 15/102,646

(22) PCT Filed: Dec. 26, 2013

(86) PCT No.: PCT/KR2013/012181
§ 371 (c)(1),
(2) Date: Jun. 8, 2016

(87) PCT Pub. No.: WO2015/099226
PCT Pub. Date: Jul. 2, 2015

(65) Prior Publication Data

US 2016/0312344 A1 Oct. 27, 2016

(30) Foreign Application Priority Data

Dec. 24, 2013 (KR) ..... 10-2013-0163226

(51) Int. Cl.
*C22C 38/04* (2006.01)

(52) U.S. Cl.
CPC ..... *C22C 38/04* (2013.01)

(58) Field of Classification Search
None
See application file for complete search history.

(56) References Cited

U.S. PATENT DOCUMENTS 5,634,990 A 6/1997 Choi et al.
5,891,388 A * 4/1999 Baik ..... C22C 38/04 420/72
9,555,158 B2 1/2017 Meyer-Kobbe et al.
(Continued)

FOREIGN PATENT DOCUMENTS

EP 0649914 4/1995
EP 2617839 7/2013
(Continued)

OTHER PUBLICATIONS

Machine—English translation of JP07-316738, Morikage Yasushi et al., Dec. 5, 1995.*
(Continued)

*Primary Examiner* — Deborah Yee
(74) *Attorney, Agent, or Firm* — Cantor Colburn LLP

(57) ABSTRACT

Provided is a steel having excellent weldability and impact toughness in a welding zone comprising: by weight (wt.) %, carbon (C): 0.1% to 0.3%, manganese (Mn): 11% to 13%, iron (Fe) as a residual component thereof, and other inevitable impurities, and positive and negative segregation zones in a layered form. The positive segregation zone comprises austenite and epsilon martensite, and the negative segregation zone comprises, by area fraction, epsilon martensite of less than 5% and alpha martensite.

5 Claims, 1 Drawing Sheet

(56) References Cited

U.S. PATENT DOCUMENTS

| | | | | |
|---|---|---|---|---|
| 2011/0002808 | A1 | 1/2011 | Mizoguchi et al. | |
| 2012/0228899 | A1* | 9/2012 | Rich | B62D 65/14 296/191 |

FOREIGN PATENT DOCUMENTS

| | | | | |
|---|---|---|---|---|
| JP | 54081118 | | 6/1979 | |
| JP | 54081119 | | 6/1979 | |
| JP | 04346636 | | 12/1992 | |
| JP | 05195156 | | 8/1993 | |
| JP | 05255813 | | 10/1993 | |
| JP | 06322440 | | 11/1994 | |
| JP | 07150300 | | 6/1995 | |
| JP | 07-316738 | * | 12/1995 | C22C 38/16 |
| JP | 10030153 | | 2/1998 | |
| JP | 2005325388 | | 11/2005 | |
| JP | 2009041079 | | 2/2009 | |
| KR | 20020091844 | | 12/2002 | |
| KR | 20080091717 | | 10/2008 | |
| KR | 20090069818 | | 7/2009 | |
| KR | 20100070366 | | 6/2010 | |
| KR | 20130043884 | | 5/2013 | |
| KR | 20130074687 | | 7/2013 | |
| KR | 20130096213 | | 8/2013 | |
| KR | 20130113670 | | 10/2013 | |
| WO | 2013107730 | | 7/2013 | |
| WO | 2013110798 | | 8/2013 | |

OTHER PUBLICATIONS

Chinese Office Action—Chinese Application No. 201380081810.8 dated Jan. 16, 2017.

European Office Action—European Application No. 13 900 236.4 dated Oct. 17, 2017.

International Search Report—PCT/KR2013/012181 dated Sep. 24, 2014.

Carpenter, et al., Microstructural characterization of aluminum passivated stainless steel weldments, Microstructual Science, 1987, pp. 137-156.

European Search Report—European Application No. 13900236.4, dated Nov. 11, 2016, citing Carpenter, et al., EP 2 617 839, JP 2005 325388, WO 2013110798 and Suh, et al.

Suh, et al., Microstructure and Mechanical Behaviors of 0.1C—13Mn Metastable Austenitic Steel, Matallurgical and Materials Transactions A, Feb. 2009, pp. 264-268.

* cited by examiner

STEEL HAVING EXCELLENT WELDABILITY AND IMPACT TOUGHNESS OF WELDING ZONE

TECHNICAL FIELD

The present disclosure relates to steel having excellent weldability and impact toughness in a welding zone.

BACKGROUND ART

Recently, there has been demand for the development of an ultra-thick steel sheet having high strength properties in consideration of the design requirements of structures to be used in the shipping, maritime, architectural, and civil engineering fields domestically and internationally. In a case in which high-strength steel is included in the design of a structure, economic benefits may be obtained due to reductions in the weight of structures while processing and welding operations may be easily undertaken using a steel sheet having a relatively reduced thickness.

However, as in the case of ultra-high strength steel, during welding operations, the microstructure in a weld heat-affected zone (HAZ) includes low-temperature transformation phase having high strength, there is a limitation in which the weld HAZ properties, in detail, toughness, is significantly reduced. For this reason, it is significant to secure the toughness in a welding zone in terms of characteristics of a structural material, but it may be technologically very difficult to simultaneously secure the properties of a base material and a welding zone in the case of ultra-high strength steel having a tensile strength of 800 MPa or greater.

In the meantime, in the case of the related art high-strength steel having a tensile strength of 600 MPa or greater, the microstructure in a weld HAZ is fine using a TiN precipitate to secure the welding zone properties (Patent Document 1), or the generation of intergranula ferrite suppressing the generation of upper bainite in the weld HAZ is promoted using an oxide metallurgy technology to improve the toughness in the weld HAZ (Patent Document 2).

However, in the case that ultra-high strength steel having a tensile strength of 800 MPa or greater is welded, the weld HAZ generally consists of a structure such as martensite having significantly low toughness, rather than an acicular ferrite structure or a bainite structure. In addition, in the case that the martensite structure is formed, the effect of grain fining caused by the creation of TiN precipitates has a limitation in securing the toughness of the weld HAZ. Furthermore, in the case of oxide metallurgy technology, the possibility of the application thereof is relatively low, due to questions about the effectiveness thereof.

Patent Document 1: Korean Patent Laid-Open Publication No. 2009-0069818

Patent Document 2: Korean Patent Laid-Open Publication No. 2002-0091844

DISCLOSURE

Technical Problem

According to an aspect of the present disclosure, steel having excellent weldability and impact toughness in a welding zone may be provided to improve weldability and properties and impact toughness in a welding zone of steel by controlling an alloy composition and a microstructure thereof.

Technical Solution

According to an aspect of the present disclosure, a steel having excellent weldability and impact toughness in a welding zone may include, by weight (wt.) %, carbon (C): 0.1% to 0.3%, manganese (Mn): 11% to 13%, iron (Fe) as a residual component thereof, and other inevitable impurities, and may comprise positive and negative segregation zones in a layered form. In addition, the positive segregation zone may comprise austenite and epsilon martensite, and the negative segregation zone may comprise, by area fraction, epsilon martensite of less than 5% and alpha martensite.

In addition, the foregoing technical solution does not list an entirety of characteristics of the present disclosure. Various characteristics of the present disclosure and consequent advantages and effects will be understood in more detail with reference to specific exemplary embodiments below.

Advantageous Effects

In steel having excellent weldability and impact toughness in a welding zone according to an exemplary embodiment in the present disclosure, the occurrence of cracking in a welding zone may be prevented and impact toughness of steel therein may be improved, by controlling an alloy composition and a microstructure of steel. Additionally, steel in the present disclosure maybe applied to an ultra-thick steel sheet.

BEST MODE FOR INVENTION

Figure 1:
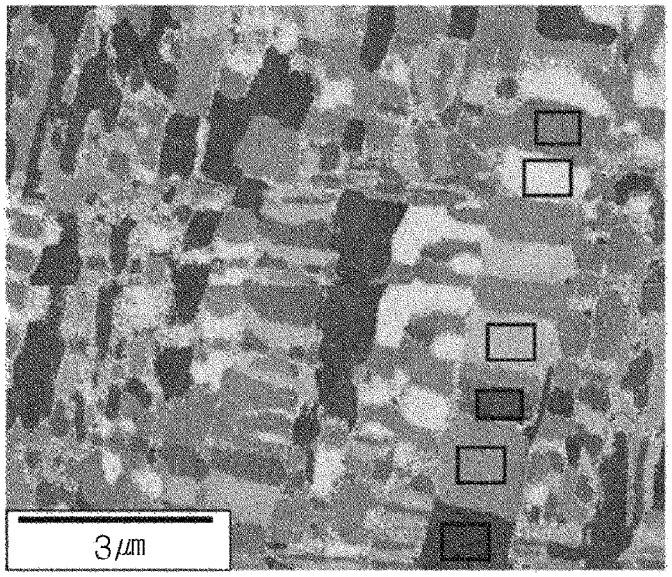
FIG. 1 is an electron back scattered diffraction (EBSD) photograph of a negative segregation zone of Inventive Example 1.

The inventors of the present disclosure conducted research in order to resolve an existing problem and to secure improved impact toughness as compared to the related art, simultaneously, resulting in devising a method of improving impact toughness and weldability by controlling an alloy design and an area fraction of a microstructure. In more detail, the inventors of the present disclosure came up with the present disclosure to resolve a problem in which high manganese steel having alpha martensite and epsilon martensite structures of the related art (the same structures as illustrated in FIG. 1) with excellent impact toughness causes non-uniform distribution of the structures when used in an actual production process.

A Fe-12Mn binary alloy of the related art may secure significantly excellent strength and impact toughness by having a microstructure formed as a lattice. However, as positive and negative segregation zones were developed by adding a large amount of manganese (Mn), there was a problem in which carbon (C) could not be excluded in the actual production process. Furthermore, in a case in which the binary alloy is produced, a degree of Mn segregation is significantly high, and impact toughness is reduced due to a generation of a large amount of epsilon martensite in the positive segregation zone and an addition of a small amount of C, and thus, the binary alloy could not be commercialized as a Fe-12Mn heterogeneous composition system.

The inventors of the present disclosure conducted research in order to solve a situation in which C may not be completely excluded in the same manner as in an actual production process and a problem in which the non-uniform alpha martensite and epsilon martensite structures are formed due to a presence of a segregation zone, resulting in the devising of the present disclosure.

In other words, fine epsilon martensite and alpha martensite structures were secured in the negative segregation zone by adding a large amount of C, while austenite and a portion of the epsilon martensite structure were generated by enriching C and Mn in the positive segregation zone, thus securing a structure having three phases. Consequently, the same structure as that of a base material, formed in a weld heat-affected zone (HAZ), led to steel having excellent welding zone properties being to be able to be provided, thus devising the present disclosure.

Hereinafter, according to an aspect of the present disclosure, steel having excellent weldability and impact toughness in a welding zone will be described in detail.

According to an exemplary embodiment in the present disclosure, steel having excellent weldability and impact toughness in a welding zone may include, by weight(wt.)%, C: 0.1% to 0.3%, Mn: 11% to 13%, iron (Fe) as a residual component thereof, and other inevitable impurities, and may comprise the positive and negative segregation zones in a layered form. In addition, the positive segregation zone may comprise, by area fraction, austenite of 50% or more and the epsilon martensite as a remainder, and the negative segregation zone may comprise, by area fraction, the alpha martensite as a matrix and epsilon martensite of less than 5% (excluding 0%).

Carbon (C): 0.1 wt. % to 0.3 wt. %

Carbon (C) is an effective component improving stability of the austenite in the positive segregation zone. In a case in which a large amount of C is included, there is a problem in which the epsilon martensite and the alpha martensite are inhibited from being generated in the negative segregation zone. Therefore, an upper limit thereof may be set to be 0.3 wt. %. On the other hand, in a case in which a significantly small amount of C is included, a large amount of the epsilon martensite is generated in the positive segregation zone. Therefore, since there is a problem in which impact toughness is reduced, a lower limit thereof may be set to be 0.1 wt. %.

Manganese (Mn): 11 wt. % to 13 wt. %

Manganese (Mn) is the most significant constituent element in the present disclosure. According to an exemplary embodiment, in order to form a microstructure, Mn of 11 wt. % or more may be included. Meanwhile, in the case that a content of Mn is significantly high, there is a problem in which a large amount of the epsilon martensite is formed in the negative segregation zone, thus making a structure thereof coarse and reducing impact toughness due to epsilon. Therefore, an upper limit thereof may be set to be 13 wt. %.

A remaining component of the present disclosure is iron (Fe). However, since unintended impurities may inevitably enter a typical production process from a material or the surrounding environment, the impurities may not be excluded. As those having skill in the art will be aware, in the case of impurities, an entirety of contents thereof is not described in specifications.

A structure formed through the alloy composition may be present to include the positive and negative segregation zones in a layered form, and may be a structure allowing the epsilon martensite and the alpha martensite to have a lattice structure in the negative segregation zone.

The negative segregation zone may include, by area fraction, the alpha martensite as a matrix and the epsilon martensite of less than 5%. In the case of a structure of the present disclosure, the epsilon martensite of less than 5% (excluding 0%) is generated first during cooling, the microstructure is cut finely, and the alpha martensite is generated from remaining austenite not transformed into the epsilon martensite, thus securing a microstructure having excellent strength and impact toughness.

The negative segregation zone may have high strength by securing the alpha martensite as a matrix. In addition, coarse alpha martensite may be prevented from being generated by securing the epsilon martensite of less than 5%. Furthermore, in the case that a large amount of the epsilon martensite is generated, there is a problem in which the epsilon martensite having a low level of ductility is modified to be rapidly transformed into the alpha martensite and produce stress, thus resulting in cracking. Therefore, an area fraction of the epsilon martensite maybe controlled to be less than 5%. In the case that the epsilon martensite is not generated, there is a problem in which a prior austenite structure is not divided by the epsilon martensite, causing the alpha martensite structure to be coarse, thus reducing impact toughness. Therefore, the epsilon martensite may be included. Furthermore, the alpha martensite has a size of 3 μm or less. In the case that an effective grain size of the alpha martensite is greater than 3 μm, there may be a problem in which impact toughness may be reduced.

The positive segregation zone may include, by area fraction, the austenite of 50% or more and the epsilon martensite as a remainder. In the case that the epsilon martensite is more than 50%, there is a problem in which when external stress is concentrated, the epsilon martensite is easily transformed into the alpha martensite, thus reducing an elongation percentage and impact toughness. Therefore, the area fraction of the epsilon martensite maybe limited to less than 50%.

Impact toughness in a welding zone of the steel may be 64J or greater at a temperature of −60° C. Impact toughness in the welding zone may secure 64J or greater at a temperature of −60° C. because in the case of carbon steel, a large amount of low-temperature transformation phase is generated by a high cooling speed of the weld HAZ, thus reducing impact toughness thereof, while steel in the present disclosure may not be affected by cooling speed due to microstructural characteristics thereof, and may secure the same microstructure as the base material in the weld HAZ.

The steel proposed in the present disclosure may secure a structure including the austenite having excellent physical properties such as strength and the like, as a matrix, in the positive segregation zone and a complex structure in which the alpha martensite structure having excellent strength and impact toughness and the epsilon martensite structure are finely generated in the negative segregation zone, and thus secure high strength and toughness. In addition, due to the microstructural characteristics of steel, the same microstructure is generated at a cooling speed from a significantly slow cooling speed to fast cooling speed. Therefore, steel proposed in the present disclosure may be applied to a production of an ultra-thick steel sheet.

Since steel proposed in the present disclosure may always have the same structure at cooling speed of 0.1° C./sec to 100° C./sec regardless of rolling conditions, and a microstructure of the weld HAZ may also always have the same structure regardless of an effect of heat, weld HAZ properties thereof are excellent. In general, in the case of the carbon steel including the martensite structure, there are many cases in which a large amount of low-temperature cracks are generated in the weld HAZ by stress after welding. However, in the case of steel proposed in the present disclosure, since a large amount of the austenite is present in the positive segregation zone, and the austenite having excellent ductility absorbs stress caused by martensite transformation at a relatively low temperature, weldability and resistance thereof to the low-temperature cracks are excellent.

A method for manufacturing steel in the present disclosure may not be limited, but may employ a general method. According to an exemplary embodiment, ingot steel satisfying the composition is manufactured to be cast in slab form. The slab is reheated at temperatures of 1,100° C. to 1,300° C., and steel is manufactured through processes of hot rolling and cooling.

INDUSTRIAL APPLICABILITY

Hereinafter, the present disclosure will be described in more detail through an exemplary embodiment. However, the exemplary embodiment below is intended to describe the present disclosure in more detail through illustration thereof, but not limit the scope of rights of the present disclosure, because the scope of rights thereof is determined by the contents of the appended claims and reasonably inferred therefrom.

Exemplary Embodiment

Steel was manufactured in such a manner that a slab having a composition detailed in Table 1 below was heated at a temperature of 1,150° C. for two hours to be hot-rolled at a temperature of 1,000° C. in a finishing process and be cooled at cooling speed of 1° C./sec, 15° C./sec, and 70° C./sec. Next, an area fraction of microstructure phases was measured by observing a microstructure of each steel through electron back scattered diffraction (EBSD) and a scanning electron microscope (SEM) and using image analysis, and results thereof are represented in Table 1. In addition, welding was carried out, and impact toughness and a presence of cracking in a welding zone were observed as represented in Table 1.

Since Inventive Examples 1 to 3 satisfying an entirety of ranges proposed in the present disclosure secure a microstructure proposed therein, Inventive Examples 1 to 3 may secure high strength and excellent impact toughness. As illustrated in FIG. 1, as a result of imaging a negative segregation zone in Inventive Example 1 using the EBSD, it could be confirmed that alpha martensite has a lattice structure. Furthermore, although epsilon martensite is not represented in FIG. 1, the epsilon martensite is present in a thin plate shape in a grain boundary of an alpha martensite structure. The epsilon martensite was generated beforehand by dividing an interior of a prior austenite grain into the lattice structure before the alpha martensite was generated.

Figure 2:
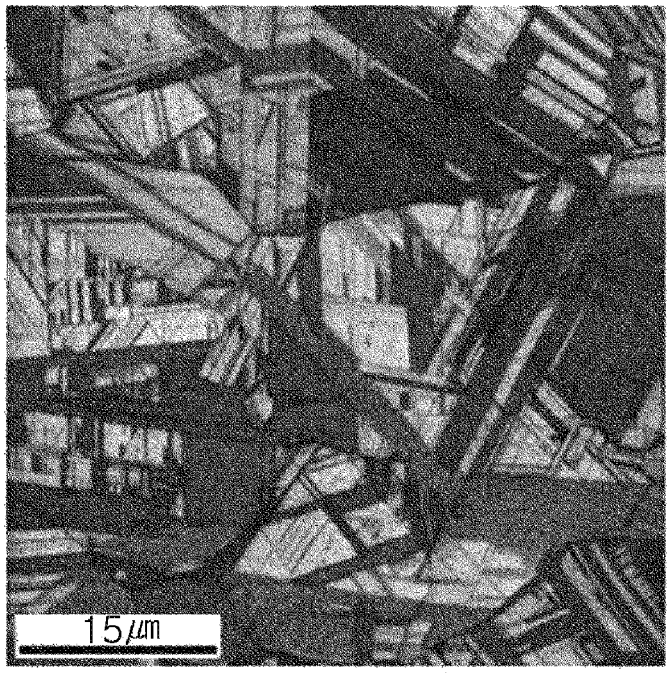
FIG. 2 is an EBSD photograph of a positive segregation zone of Inventive Example 3.

FIG. 2 is a photograph of a positive segregation zone of Inventive Example 3. In addition, as illustrated in FIG. 2, it can be confirmed that the epsilon martensite corresponding to a dark area has been generated in a thin plate shape within austenite corresponding to a bright area.

In the meantime, component ranges of carbon (C) and manganese (Mn) in Comparative Example 1 are lower than those of C and Mn, proposed in the present disclosure. Due to components C and Mn, the epsilon martensite was not generated in the negative segregation zone, and an entirety of microstructures was transformed into the alpha martensite, and thus a structure thereof became significantly coarse. Furthermore, in the case of the positive segregation zone, a large amount of the epsilon martensite is generated, and thus impact toughness in a weld heat-affected zone (HAZ) is significantly relatively low. In addition, it can be confirmed that as a large amount of coarse martensite is generated in the negative segregation zone, a low-temperature crack occurred during welding.

In addition, component ranges of C and Mn in Comparative Examples 2 and 3 were higher than those of C and Mn, proposed in the present disclosure. Additionally, a large amount of the epsilon martensite was generated in the negative segregation zone, so that the microstructure became coarse, and impact toughness thereof was reduced. Thus, it can be confirmed that impact toughness of the weld HAZ was reduced, although a large amount of the austenite was generated in the positive segregation zone.

While exemplary embodiments have been shown and described above, it will be apparent to those skilled in the art

TABLE 1

| | | | Negative Segregation Zone | | | Positive Segregation Zone | | Welding Zone | |
|---|---|---|---|---|---|---|---|---|---|
| | | | Microstructure (Area %) | | Grain | Microstructure (Area %) | | Impact Toughness (J) | Presence |
| Classification | C (wt. %) | Mn (wt. %) | Alpha Martensite | Epsilon Martensite | Size (μm) | Epsilon Martensite | Austenite | at −60° C. | of Crack |
| Inventive Example 1 | 0.15 | 12.2 | 95.3 | 3.5 | 2.2 | 41 | 59 | 105 | None |
| Inventive Example 2 | 0.21 | 11.7 | 96.2 | 4.1 | 2.1 | 36 | 64 | 98 | None |
| Inventive Example 3 | 0.26 | 12.5 | 96.9 | 4.9 | 2.4 | 28 | 72 | 86 | None |
| Comparative Example 1 | 0.08 | 10.7 | 100 | 0 | 23.5 | 67 | 33 | 12 | Present |
| Comparative Example 2 | 0.35 | 12.3 | 88 | 12 | 11.5 | 25 | 75 | 18 | None |
| Comparative Example 3 | 0.22 | 13.8 | 92 | 15 | 13.5 | 12 | 88 | 23 | None |

that modifications and variations could be made without departing from the scope of the present invention as defined by the appended claims.

The invention claimed is:

1. A steel having excellent weldability and impact toughness in a welding zone, comprising:

by weight(wt.)%, carbon (C): 0.1% to 0.3%, manganese (Mn): 11% to 13%, iron (Fe) as a residual component thereof, and other inevitable impurities, and positive and negative segregation zones in a layered form, wherein the positive segregation zone comprises austenite and epsilon martensite, and the negative segregation zone comprises, by area fraction, epsilon martensite of less than 5% (excluding 0%) and alpha martensite.

2. The steel having excellent weldability and impact toughness in a welding zone of claim 1, wherein the epsilon martensite and the alpha martensite have a lattice structure in the negative segregation zone.

3. The steel having excellent weldability and impact toughness in a welding zone of claim 1, wherein the positive segregation zone comprises the austenite of 50% or more and the epsilon martensite as a remainder.

4. The steel having excellent weldability and impact toughness in a welding zone of claim 1, wherein an effective grain size of the alpha martensite is 3 μm or less.

5. The steel having excellent weldability and impact toughness in a welding zone of claim 1, further comprising: a welding zone where the steel has been welded, wherein the welding zone has an impact toughness of 64J or greater at a temperature of −60 ° C.

* * * * *